US006817547B2

(12) United States Patent
Boehland

(10) Patent No.: US 6,817,547 B2
(45) Date of Patent: Nov. 16, 2004

(54) FUEL INJECTION DEVICE FOR AN INTERNAL COMBUSTION ENGINE

(75) Inventor: Peter Boehland, Marbach (DE)

(73) Assignee: Robert Bosch GmbH, Stuttgart (DE)

( * ) Notice: Subject to any disclaimer, the term of this patent is extended or adjusted under 35 U.S.C. 154(b) by 171 days.

(21) Appl. No.: 10/216,230

(22) Filed: Aug. 12, 2002

(65) Prior Publication Data

US 2003/0042334 A1 Mar. 6, 2003

(30) Foreign Application Priority Data

Aug. 10, 2001 (DE) ..... 101 39 545

(51) Int. Cl.[7] ..... F02M 59/00; F02M 61/00; F02M 63/00; F02M 51/00; F02M 61/20

(52) U.S. Cl. ..... 239/533.2; 239/585.5; 239/533.9

(58) Field of Search ..... 239/88–92, 585.1, 239/585.2, 585.3, 585.4, 585.5, 533.2, 533.3, 533.9; 123/467

(56) References Cited

U.S. PATENT DOCUMENTS 4,951,631 A * 8/1990 Eckert ..... 123/446
5,056,488 A * 10/1991 Eckert ..... 123/446
5,611,317 A * 3/1997 Peters et al. ..... 123/501
6,257,499 B1 * 7/2001 Sturman ..... 239/96
6,283,390 B1 * 9/2001 Brendle et al. ..... 239/533.2

* cited by examiner

*Primary Examiner*—Michael Mar
*Assistant Examiner*—Darren Gorman
(74) *Attorney, Agent, or Firm*—Ronald E. Greigg

(57) ABSTRACT

The fuel injection device has a fuel injection valve that has an injection valve member, which is guided so that it can slide in a valve body and controls at least one injection opening and which can be moved in the opening direction, counter to the force of a closing spring contained in a spring chamber by means of the pressure prevailing in a pressure chamber of the fuel injection valve. Highly pressurized fuel is supplied from a high pressure source to the pressure chamber of the fuel injection valve. An electrically controlled valve at least indirectly controls a connection of the pressure chamber to a relief chamber and connects the pressure chamber to the relief chamber in order to terminate the fuel injection. The pressure chamber of the fuel injection valve has a connection to the spring chamber, which connection contains a check valve that opens toward the pressure chamber.

20 Claims, 3 Drawing Sheets

FUEL INJECTION DEVICE FOR AN INTERNAL COMBUSTION ENGINE

BACKGROUND OF THE INVENTION

1. Field of the Invention

The current invention directed to an improved fuel injection device for an internal combustion engine.

2. Description of the Prior Art

A fuel injection device known from DE 28 08 731 C2 includes a fuel injection valve, which has an injection valve member that is guided so that it can slide in a bore of a valve body and control at least one injection opening. The pressure prevailing in a pressure chamber of the fuel injection valve can move the injection valve member in an opening direction, counter to the force of a closing spring disposed in a spring chamber, in order to unblock the at least one injection opening. A predetermined pressure is maintained in the spring chamber and this spring chamber can, for example, be connected to a low-pressure region. In order to initiate fuel injection, highly pressurized fuel is supplied to the pressure chamber of a fuel injection valve from a high pressure source. An electrically controlled valve at least indirectly controls a connection from the pressure chamber or the high pressure source to a relief chamber. In order to terminate the fuel injection, the valve opens the connection to the relief chamber so that the pressure in the pressure chamber decreases and the fuel injection valve closes. The pressure in the pressure chamber decreases very sharply so that in some circumstances, it falls below the vapor pressure of the fuel so that cavitation occurs. This creates intense wear and loud noise, which are to be avoided.

OBJECT AND SUMMARY OF THE INVENTION

The fuel injection device according to the invention has the advantage over the prior art that a check valve permits a pressure compensation between the pressure chamber and the spring chamber when the pressure in the pressure chamber is lower than in the spring chamber. This prevents the pressure in the pressure chamber from dropping below the vapor pressure of the fuel so that no cavitation occurs. The wear and noise emission of the fuel injection device according to the invention are therefore reduced.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
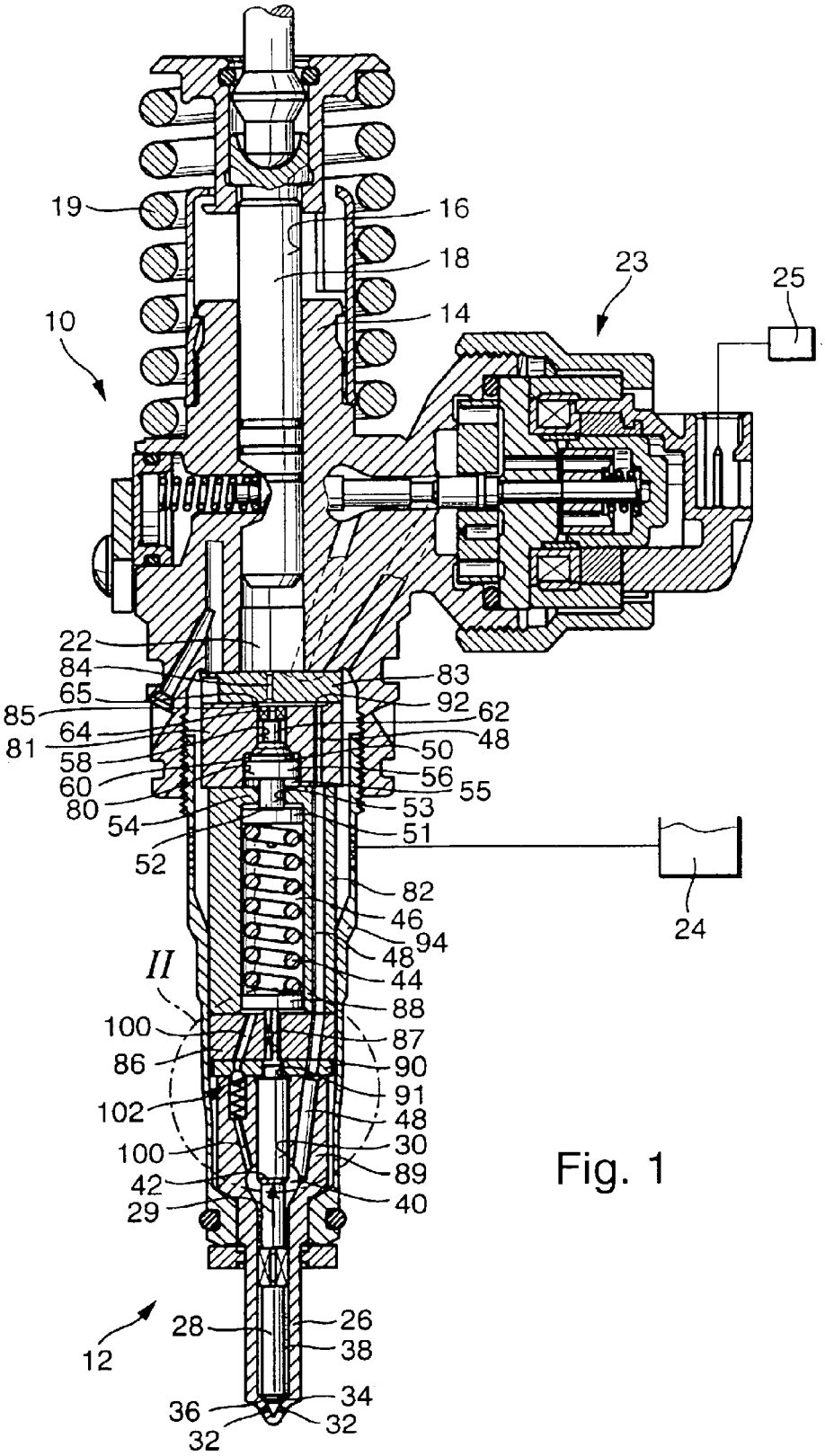
FIG. 1 shows a schematic depiction of a fuel injection device for an internal combustion engine.

FIG. 1 shows a fuel injection device for an internal combustion engine, for example of a motor vehicle. The engine is an auto-ignition engine and has one or more cylinders and a fuel injection valve 12 for each cylinder. In the embodiment of the fuel injection device shown in FIG. 1, the device has a high-pressure fuel pump 10 for each cylinder of the engine. The high-pressure fuel pump 10 and the fuel injection valve 12 are combined into a so-called unit fuel injector. The high-pressure fuel pump 10 and the fuel injection valve 12, however, can also be separate from each other and be connected to each other by means of a line. The high-pressure fuel pump 10 has a pump body 14, in which a cylinder bore 16 has a pump piston 18 guided in it in a sealed fashion, which is driven in a stroke motion counter to the force of a restoring spring 19 by a cam on a camshaft of the engine. The pump piston 18 defines a pump working chamber 22 in the cylinder bore 16, in which fuel is compressed at high pressure during the delivery stroke of the pump piston 18. During the intake stroke of the pump piston 18, the pump working chamber 22 is supplied with fuel from a fuel tank 24, for example by means of a delivery pump. The pump working chamber 22 has a connection to a relief chamber, which function can be fulfilled by the fuel tank 24, for example, and this connection is controlled by an electrically controlled valve 23. The electrically controlled valve 23 is connected to a control unit 25.

The fuel injection valve 12 has a valve body 26, which is embodied of multiple parts, as will be explained in more detail below, and is connected to the pump body 14. The valve body 26 contains a bore 30 in which an injection valve member 28 is guided so that it can move longitudinally. The bore 30 extends at least approximately parallel to the cylinder 16 of the pump body 14, but can also be inclined in relation to it. In its end region oriented toward the combustion chamber in the cylinder of the engine, the valve body 26 has at least one and preferably several injection openings 32. In its end region oriented toward the combustion chamber, the injection valve member 28 has a for example approximately conical sealing surface 34 that cooperates with a valve seat 36, which is likewise approximately conical and is embodied in the end region of the valve body 26 oriented toward the combustion chamber; the injection openings 32 branch off from this valve seat 36 or branch off downstream of it.

Between injection valve member 28 and the bore 30 toward the valve seat 36, the valve body 26 is provided with an annular chamber 38, which, in its end region oriented away from the valve seat 36, transitions by means of a radial expansion of the bore 30 into a pressure chamber 40 encompassing the injection valve member 28. At the level of the pressure chamber 40, the injection valve member 28 has a pressure shoulder 42 that points toward the valve seat 36 by means of a cross sectional restriction. The end of the injection valve member 28 remote from the combustion chamber supports a prestressed closing spring 44, which presses the injection valve member 28 toward the valve seat 36. The closing spring 44 is contained in a spring chamber 46, which adjoins the bore 30. The pressure chamber 40 is connected to the pump working chamber 22 by means of a conduit 48 extending through the valve body 26.

At one end, the closing spring 44 is supported at least indirectly, for example by means of a spring plate, against the injection valve member 28 and at the other end, the closing spring 44 is supported at least indirectly, for example likewise by means of a spring plate 51, against a deflecting piston 50. The deflecting piston 50 is guided in a bore 80 of a housing part 81 and at its end region oriented toward the closing spring 44, has a shaft part 52, which passes through a connecting bore 53 in a dividing wall 54 of the housing part 81 between the spring chamber 46 and a storage volume 55 adjoining it in the housing part 81. The spring plate 51 is supported at the end of a shaft part 52 protruding into the spring chamber 46. The connecting bore 53 has a smaller diameter than the spring chamber 46 and the storage volume 55. In the storage volume 55, the deflecting piston 50 has a region 56 with a larger diameter than the connecting bore 53 so that a stroke motion of the deflecting piston 50 into the spring chamber 46 is limited by the fact that the region 56 of the deflecting piston 50 comes into contact with the dividing wall 54 that functions as a stop. The deflecting piston 50 is guided in a sealed fashion with its region 56 in the bore 80 that has a correspondingly greater diameter than the connecting bore 53. The spring chamber 46 is embodied as a bore in a housing part 82 that constitutes a part of the valve body 26. The conduit 48 chamber 46 and approximately parallel to it.

From the end of the storage volume 55 remote from the spring chamber 46, a bore 58 leads toward the pump working chamber 22 in the housing part 81. The bore 58 has a smaller diameter than the bore 80. Oriented toward the bore 58 and adjoining the region 56, the deflecting piston 50 has a sealing surface 60, which is embodied approximately in the shape of a cone, for example. The sealing surface 60 cooperates with the mouth of the bore 58, which opens into the storage volume 55 on the housing part 81 and functions as a seat that can also be embodied as approximately conical. The deflecting piston 50 has a shaft 62, which protrudes into the bore 58 and whose diameter is smaller than that of the region 56. Adjoining the sealing surface 60, the shaft 62 at first has a significantly smaller diameter than the bore 58 and then, toward its free end, has a shaft region 64 with a diameter that is only slightly smaller than the diameter of the bore 58. On its circumference, the shaft region 64 can have one or more flattened zones 65, which constitute openings between the shaft region 64 and the bore 58 through which fuel can travel into the storage volume 55.

An intermediary disk 83 is provided between the housing part 81 and the pump body 14 and contains a bore 84, which connects the bore 58 in the housing part 81 to the pump working chamber 22. The bore 84 represents a throttle restriction that connects the bore 58 to the pump working chamber 22. In the bore 58 toward the intermediary disk 83, the deflecting piston 50 defines an antechamber 85 that is connected to the pump working chamber 22 by means of the throttle restriction 84.

When the deflecting piston 50 is disposed in a starting position, in which it rests with its sealing surface 60 against the sealing seat at the mouth of the bore 58, then the storage volume 55 is closed off from the antechamber 85 and consequently from the pump working chamber 22. In the starting position of the deflecting piston 50, the pressure prevailing in the pump working chamber 22 acts on the end surface of the shaft region 64 and, through the openings between the shaft region 64 and the bore 58, acts on the sealing surface 60 of the deflecting piston 50 in accordance with the diameter of the bore 58. The force of the closing spring 44 holds the deflecting piston 50 in its starting position, counter to the pressure prevailing in the pump working chamber 22 and therefore in the antechamber 85, when the force that the pressure in the pump working chamber 22 exerts on the deflecting piston 50 is less than the force of the closing spring 44.

If the pressure in the pump working chamber 22 and therefore in the antechamber 85 increases so sharply that the force exerted on the deflecting piston 50 becomes greater than the force of the closing spring 44, then the deflecting piston 50, together with the shaft part 52, moves in a compensating motion into the storage volume 55, as a result of which the shaft part 52 moves into the spring chamber 46. With the compensating motion of the deflecting piston 50, fuel is displaced from the storage volume 55 into the spring chamber 46 and must pass through an annular gap between the shaft part 52 of the deflecting piston 50 and the connecting bore 53. This produces a damping of the compensating motion of the shaft part 52 and therefore of the deflecting piston 50.

Toward the fuel injection valve 12, the housing part 82 is adjoined by an additional housing part 86 provided as part of the valve body 26, which has a bore 87, through which an end region of the injection valve member 28 passes and protrudes into the spring chamber 46. The end region of the injection valve member 28 is supported against the closing spring 44 by means of a spring plate 88 in the spring chamber 46. The end region of the injection valve member 28 has a smaller diameter than its region that is guided in the bore 30. The bore 30, the pressure chamber 40, and the annular chamber 38, at the lower end of which the valve seat 34 and the injection openings 32 are disposed, are embodied in a valve housing 89 that constitutes a part of the valve body 26. A thin intermediary disk 90 is disposed between the housing part 86 and the valve housing 89. The intermediary disk 90 has a bore 91 through which the end region of the injection valve member 28 passes.

The conduit 48 extends from the pressure chamber 40 and through the valve housing 89, the intermediary disk 90, the housing part 86, and the housing part 82. At its end oriented toward the intermediary disk 83, the housing part 82 has a groove 92, into which the conduit 48 feeds and which is connected to the antechamber 85. The conduit 48 is consequently connected to the pump working chamber 22 by means of the groove 92, the antechamber 85, and the bore 84. Alternatively, it is also possible for the conduit 48 to bypass the antechamber 85 and be connected directly to the pump working chamber 22 by means of a bore in the intermediary disk 83. The on its side oriented toward the pump body 14, the intermediary disk 83 can have a groove, which opens toward the pump working chamber 22 and feeds into the conduit 48. For example, the groove can extend approximately radial to the cylinder bore 16 and extend from the cylinder bore 16 outward into the region of the intermediary disk 83 through which the conduit 48 passes. The connection of the pressure chamber 40 of the fuel injection valve 12 to the pump working chamber 22 by means of the conduit 48 in this instance takes place directly, bypassing the antechamber 85 that the deflecting piston 50 defines in the bore 58 toward the intermediary disk 83.

The fuel injection valve 12 and the high-pressure fuel pump 10 are connected to each other by means of a clamping sleeve 94. The clamping sleeve 94 encompasses the valve housing 89 and is screwed into a threaded bore 95 in the pump body 14. The intermediary disk 83, the housing parts 81, 82, 86, and the intermediary disk 90 are clamped between the valve housing 89 and the pump body 14.

The spring chamber 46 is connected to a low-pressure region, for example to the fuel tank 24 or to a region in which a somewhat elevated pressure is maintained, for example 2 to 5 bar. An additional conduit 100 leads from the pressure chamber 40 of the fuel injection valve 12 toward the intermediary disk 90; this additional conduit 100 is offset in the circumference direction in relation to the conduit 48 and is disposed approximately diametrically opposite it, for example. The conduit 100 continues on through the intermediary disk 90 and the housing part 86 and feeds into the spring chamber 46 in the housing part 82. The conduit 100 contains a check valve 102, which opens toward the pressure chamber 40. The check valve 102 has a valve member 106, which is acted on in the closing direction by a closing spring 104.

Figure 2:
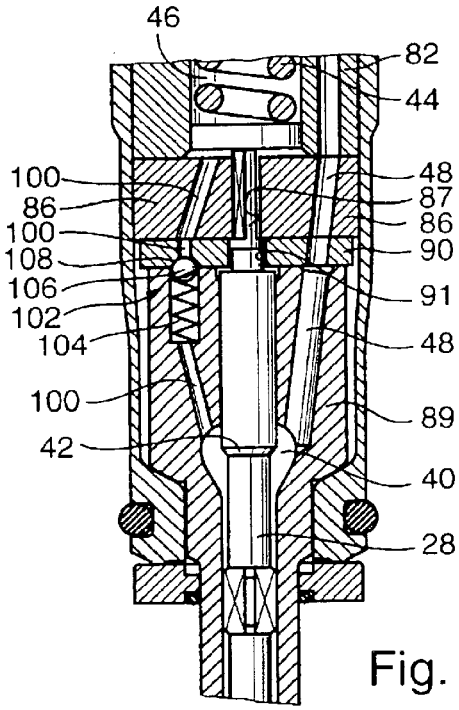
FIG. 2 shows an enlarged detail of the fuel injection device, which is labeled with II in FIG. 1, according to a first exemplary embodiment.

In a first exemplary embodiment shown in FIG. 2, the check valve 102 is disposed between the valve housing 89 and the intermediary disk 90. Toward the intermediary disk 90, the diameter of the conduit 100 in the valve housing 89 is enlarged and contains the closing spring 104 and the valve member 106. In the intermediary disk 90, the conduit 100 has a smaller cross section than the valve member 106; the mouth of the conduit 100 on the side of the intermediary disk 90 oriented toward the valve housing 89 constitutes a valve seat 108, which cooperates with the valve member 106. The closing spring 104 presses the valve member 106 against this valve seat 108.

Figure 3:
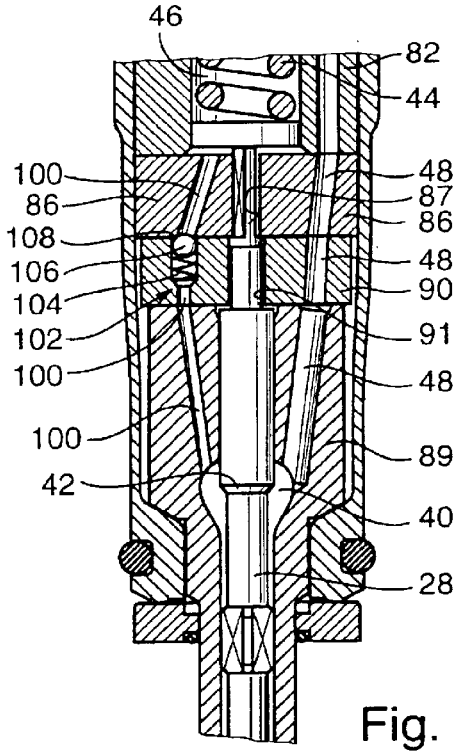
FIG. 3 shows the detail II of the fuel injection device according to a second exemplary embodiment.

FIG. 3 shows a second exemplary embodiment in which the check valve 102 is disposed in the intermediary disk 90, which is somewhat thicker than in the first exemplary embodiment in order to accommodate the check valve 102. The conduit 100 can have a constant cross section in the valve housing 89 and transitions into the intermediary disk 90. On the side of the intermediary disk 90 oriented toward the housing part 86, the conduit 100 has a larger cross section; this region of the conduit 100 contains the closing spring 104 and the valve member 106. In the housing part 86, the conduit 100 has a smaller cross section than the valve member 106; the mouth of the conduit 100 on the side of the housing part 86 oriented toward the intermediary disk 90 constitutes a valve seat 108, which cooperates with the valve member 106. The closing spring 104 presses the valve member 106 against this valve seat 108.

The function of the fuel injection device will be explained below. The pump working chamber 22 is filled with fuel during intake stroke of the pump piston 18. During the delivery stroke of the pump piston 18, the control valve 23 is at first open so that high pressure cannot build up in the pump working chamber 22. To initiate the fuel injection, the control unit 25 closes the control valve 23 so that the pump working chamber 22 is closed off from the fuel tank 24 and high pressure builds up in it. When the pressure in the pump working chamber 22 and in the pressure chamber 40 becomes high enough for the force in the opening direction 29 acting on the injection valve member 28 by means of the pressure shoulder 42 to exceed the force of the closing spring 44, then the injection valve member 28 moves in the opening direction 29 and unblocks the at least one injection opening 32 through which the fuel is injected into the combustion chamber of the cylinder. The deflecting piston 50 here is disposed in its starting position. The pressure in the pump working chamber 22 then continues to increase in accordance with the profile of the cam driving the pump piston 18.

If the force, which is exerted on the deflecting piston 50 by the pressure prevailing in the pump working chamber 22 and therefore in the antechamber 85, is greater than the force exerted on the deflecting piston 50 by the closing spring 44, then the deflecting piston 50 executes its deflecting stroke motion and moves into the storage volume 55. This causes a pressure decrease in the pump working chamber 22 and also increases the initial stress of the closing spring 44, which is supported against the deflecting piston 50 by means of the shaft part 52. The pressure decrease in the pump working chamber 22 and in the pressure chamber 40 results in a weaker force in the opening direction 29 on the injection valve member 28 and the increase in the initial stress of the closing spring 44 results in a stronger force in the closing direction on the injection valve member 28, which causes this injection valve member to move back in the closing direction until its sealing surface 34 comes to contact with the valve seat 36 and closes the injection openings 32 so that the fuel injection is terminated. In this instance, the fuel injection valve 12 is opened for only a short duration and only a small quantity of fuel is injected into the combustion chamber as a preinjection. The injected fuel quantity is essentially determined by the opening pressure of the deflecting piston 50, i.e. the pressure in the pump working chamber 22 and in the antechamber 85 at which the deflecting piston 50 begins its deflecting motion. A damping device can hydraulically limit the opening stroke of the injection valve member 28 during the preinjection.

The pressure in the pump working chamber 22 then continues to increase in accordance with the profile of the cam driving the pump piston 18 so that the compressive force acting on the injection valve member 28 in the opening direction 29 increases further and overcomes the closing force, which is increased due to the increased initial stress of the closing spring 44, so that the fuel injection valve 12 opens once more. In this instance, a larger fuel quantity is injected over a longer duration than during the preinjection. The duration and the fuel quantity injected during this main injection are determined by the time at which the control unit 25 opens the control valve 23 again. After the control valve 23 is opened, the pump working chamber 22 is once again connected to the fuel tank 24 so that it is pressure relieved and the fuel injection valve 12 closes. The deflecting piston 50 with the shaft part 52 is moved back into its starting position by the force of the closing spring 44.

If the pressure in the pressure chamber 40 is greater than the pressure in the spring chamber 46, then the spring chamber 46 is closed off from the pressure chamber 40 by the closed check valve 102. If the control valve 23 opens the connection of the pump working chamber 22 and therefore indirectly also of the pressure chamber 40 of the fuel injection valve 12 to the relief chamber in order to terminate the fuel injection, then the pressure in the pressure chamber 40 decreases sharply. When the pressure in the pressure chamber 40 falls below the pressure in the spring chamber 46, then the check valve 102 opens so that the pressure in the pressure chamber 40 cannot fall below the pressure prevailing in the spring chamber 46 and fuel flows out of the spring chamber 46 into the pressure chamber 40. This prevents cavitation in the pressure chamber 40.

Figure 4:
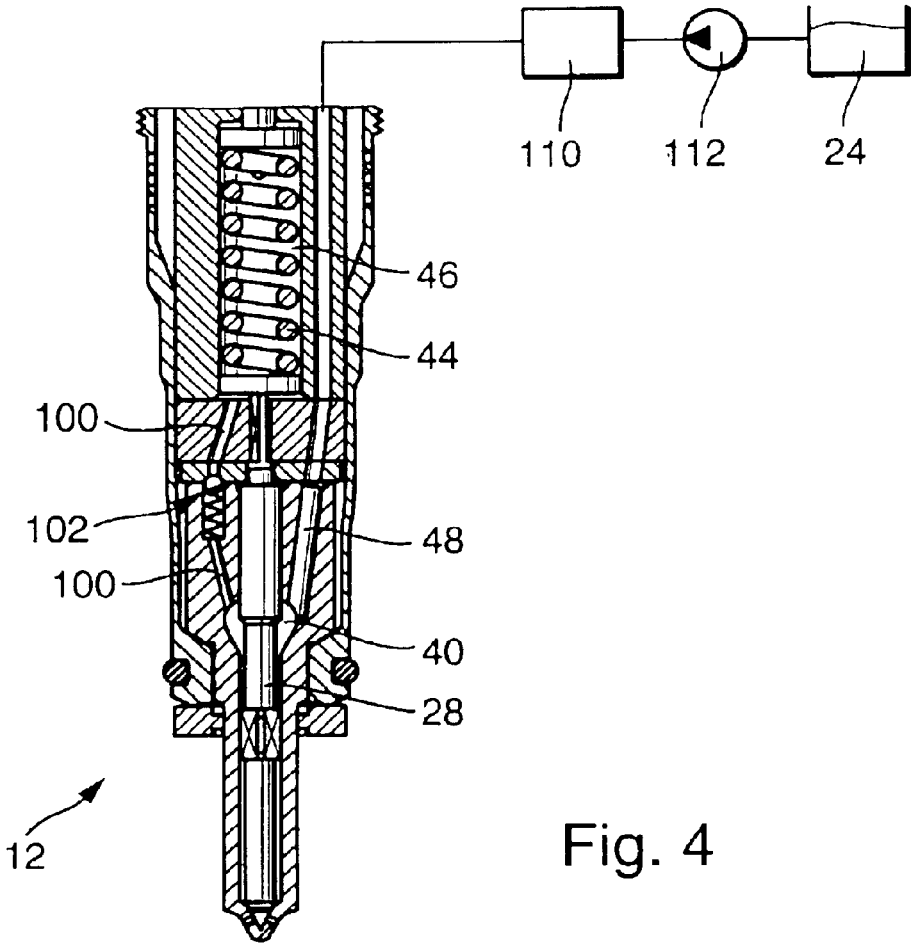
FIG. 4 shows the fuel injection device according to a third exemplary embodiment.

FIG. 4 shows the fuel injection device according to a third exemplary embodiment in which the embodiment of the fuel injection valve 12 with the check valve 102 is the same as in the first or second exemplary embodiment, but instead of the high-pressure fuel pump 10, a high-pressure reservoir 110 serves as the high pressure source from which highly pressurized fuel is supplied to the pressure chamber 40 of the fuel injection valve 12. Fuel is delivered into the high-pressure reservoir 110 by a high-pressure pump 112. An electrically controlled valve 123, which is controlled by a control unit 125, is provided between the high-pressure reservoir 110 and the pressure chamber 40 of the fuel injection valve 12. The high-pressure reservoir 110 serves as a pressure source for some or all of the fuel injection valves 12 of the internal combustion engine. The function of the fuel injection valve 12 with the check valve 102 is the same as those explained above.

The foregoing relates to preferred exemplary embodiments of the invention, it being understood that other variants and embodiments thereof are possible within the spirit and scope of the invention, the latter being defined by the appended claims.

I claim:

1. In a fuel injection device for an internal combustion engine, having a fuel injection valve (12) that has an injection valve member (28), which is guided so that it can slide in a valve body (26) and controls at least one injection opening (32) and which can be moved in the opening direction (29), counter to the force of a closing spring (44) contained in a spring chamber (46) by means of the pressure prevailing in a pressure chamber (40) of the fuel injection valve (12), in which highly pressurized fuel is supplied from a high pressure source (10; 110) to the pressure chamber (40) of the fuel injection valve (12) in order to initiate fuel injection, and having an electrically controlled valve (23; 123), which at least indirectly controls a connection of the pressure chamber (40) to a relief chamber (24) and which connects the pressure chamber (40) to the relief chamber (24) in order to terminate the fuel injection, the improvement wherein the pressure chamber (40) of the fuel injection valve (12) has a connection (100) to the spring chamber (46), which connection contains a check valve (102) that opens toward the pressure chamber (40).

2. The fuel injection valve according to claim 1, wherein the spring chamber (46) is connected to a low-pressure region in which a relatively low pressure is maintained.

3. The fuel injection valve according to claim 1, wherein the check valve (102) has a valve member (106) that is acted on in its closing direction by a closing spring (104).

4. The fuel injection valve according to claim 2, wherein the check valve (102) has a valve member (106) that is acted on in its closing direction by a closing spring (104).

5. The fuel injection valve according to claim 1, wherein the high pressure source comprises a separate high-pressure fuel pump (10) for each fuel injection valve (12), which pump (10) supplies the fuel to the pressure chamber (40) of the fuel injection valve (12).

6. The fuel injection valve according to claim 2, wherein the high pressure source comprises a separate high-pressure fuel pump (10) for each fuel injection valve (12), which pump (10) supplies the fuel to the pressure chamber (40) of the fuel injection valve (12).

7. The fuel injection valve according to claim 3, wherein the high pressure source comprises a separate high-pressure fuel pump (10) for each fuel injection valve (12), which pump (10) supplies the fuel to the pressure chamber (40) of the fuel injection valve (12).

8. The fuel injection valve according to claim 4, wherein the high pressure source comprises a separate high-pressure fuel pump (10) for each fuel injection valve (12), which pump (10) supplies the fuel to the pressure chamber (40) of the fuel injection valve (12).

9. The fuel injection valve according to claim 1, wherein the high pressure source comprises a high pressure reservoir (110), which functions as a high pressure source for a number of fuel injection valves (12), the reservoir (110) being supplied with fuel by a high-pressure pump (112), and supplying fuel to the pressure chamber (40) of the fuel injection valve (12).

10. The fuel injection valve according to claim 2, wherein the high pressure source comprises a high pressure reservoir (110), which functions as a high pressure source for a number of fuel injection valves (12), the reservoir (110) being supplied with fuel by a high-pressure pump (112), and supplying fuel to the pressure chamber (40) of the fuel injection valve (12).

11. The fuel injection valve according to claim 3, wherein the high pressure source comprises a high pressure reservoir (110), which functions as a high pressure source for a number of fuel injection valves (12), the reservoir (110) being supplied with fuel by a high-pressure pump (112), and supplying fuel to the pressure chamber (40) of the fuel injection valve (12).

12. The fuel injection valve according to claim 1, wherein the valve body (26) of the fuel injection valve (12) is comprised of a number of parts and has a valve housing (89) and an intermediary disk (90) attached to this housing on its end oriented toward the spring chamber (46), and wherein the check valve (102) has a valve member (106) disposed in the valve housing (89), which cooperates with a valve seat (108) embodied on the intermediary disk (90).

13. The fuel injection valve according to claim 2, wherein the valve body (26) of the fuel injection valve (12) is comprised of a number of parts and has a valve housing (89) and an intermediary disk (90) attached to this housing on its end oriented toward the spring chamber (46), and wherein the check valve (102) has a valve member (106) disposed in the valve housing (89), which cooperates with a valve seat (108) embodied on the intermediary disk (90).

14. The fuel injection valve according to claim 3, wherein the valve body (26) of the fuel injection valve (12) is comprised of a number of parts and has a valve housing (89) and an intermediary disk (90) attached to this housing on its end oriented toward the spring chamber (46), and wherein the check valve (102) has a valve member (106) disposed in the valve housing (89), which cooperates with a valve seat (108) embodied on the intermediary disk (90).

15. The fuel injection valve according to claim 5, wherein the valve body (26) of the fuel injection valve (12) is comprised of a number of parts and has a valve housing (89) and an intermediary disk (90) attached to this housing on its end oriented toward the spring chamber (46), and wherein the check valve (102) has a valve member (106) disposed in the valve housing (89), which cooperates with a valve seat (108) embodied on the intermediary disk (90).

16. The fuel injection valve according to claim 1, wherein the valve body (26) of the fuel injection valve (12) is comprised of a number of parts and has a valve housing (89) as well as an intermediary disk (90) and a housing part (82) attached to this valve housing (89), and wherein the check valve (102) is disposed in the intermediary disk (90) or in the housing part (82).

17. The fuel injection valve according to claim 2, wherein the valve body (26) of the fuel injection valve (12) is comprised of a number of parts and has a valve housing (89) as well as an intermediary disk (90) and a housing part (82) attached to this valve housing (89), and wherein the check valve (102) is disposed in the intermediary disk (90) or in the housing part (82).

18. The fuel injection valve according to claim 3, wherein the valve body (26) of the fuel injection valve (12) is comprised of a number of parts and has a valve housing (89) as well as an intermediary disk (90) and a housing part (82) attached to this valve housing (89), and wherein the check valve (102) is disposed in the intermediary disk (90) or in the housing part (82).

19. The fuel injection valve according to claim 5, wherein the valve body (26) of the fuel injection valve (12) is comprised of a number of parts and has a valve housing (89) as well as an intermediary disk (90) and a housing part (82)

attached to this valve housing (89), and wherein the check valve (102) is disposed in the intermediary disk (90) or in the housing part (82).

20. The fuel injection valve according to claim 9, wherein the valve body (26) of the fuel injection valve (12) is comprised of a number of parts and has a valve housing (89) as well as an intermediary disk (90) and a housing part (82) attached to this valve housing (89), and wherein the check valve (102) is disposed in the intermediary disk (90) or in the housing part (82).

* * * * *